United States Patent [19]

Richmon

[11] 4,203,506

[45] May 20, 1980

[54] ELEVATOR CONTROL

[76] Inventor: Sidney Richmon, 5800 W. Club La., Richmond, Va. 23226

[21] Appl. No.: 856,957

[22] Filed: Dec. 2, 1977

[51] Int. Cl.[2] ..... B66B 1/36

[52] U.S. Cl. ..... 187/29 R

[58] Field of Search ..... 187/29

[56] References Cited

U.S. PATENT DOCUMENTS

| | | | |
|---|---|---|---|
| 2,598,214 | 5/1952 | Borden | 187/29 |
| 2,792,080 | 5/1957 | Dunlop | 187/29 |
| 2,840,188 | 6/1958 | Savage | 187/29 |
| 2,938,603 | 5/1960 | Loughridge | 187/29 |
| 3,223,200 | 12/1965 | Lejeune | 187/29 |
| 3,407,905 | 10/1968 | Gingrich | 187/29 |
| 3,765,510 | 10/1973 | Richmon | 187/29 |
| 4,007,811 | 2/1977 | Ozawa | 187/29 |

*Primary Examiner*—J. V. Truhe
*Assistant Examiner*—W. E. Duncanson, Jr.
*Attorney, Agent, or Firm*—Griffin, Branigan & Butler

[57] ABSTRACT

An apparatus for selecting a floor, and slowing down and leveling an elevator is described. At least one wire or rod extends vertically along the elevator shaft. The wire or rod is of a nonmagnetic material and has magnetic coatings thereon along selected segments of its length. A number of magnetic sensors are mounted to the elevator. A circuit responsive to the sensor outputs produces control signals dependent on the length of each segment of magnetic coating.

5 Claims, 9 Drawing Figures

ELEVATOR CONTROL

BACKGROUND OF THE INVENTION

This invention relates to an elevator control apparatus suitable for controlling several elevator functions.

In U.S. Pat. No. 2,674,348 to Santini et al., an automatic elevator system is disclosed in which inductor plates mounted along the elevator shaft are detected by sensors mounted on the elevator to give automatic slowdown and leveling control signals. A prime disadvantage of the Santini et al. system is that it requires a very close tolerance as to the position of the elevator within the shaft in order for the sensors to be properly oriented with respect to the fixed inductor plates. The problem of positioning the sensors adjacent the inductor plates makes the Santini et al. system very speed limited. Another disadvantage of that system is that for proper control, certain of the sensors must be switched off, depending on whether the elevator is moving upward or downward.

In U.S. Pat. No. 2,840,188 to Savage, an improvement to the Santini et al. system is described. In that system, the magnetic plates are mounted on a nonmagnetic ribbon which extends the length of the elevator shaft. Although the Savage system reduces the requirement for close tolerance as to the position of the elevator within the shaft, the system does require a guide system for the nonmagnetic ribbon; and the guide system, therefore, must nevertheless meet close tolerances. The magnetic sensors in the Savage system must be precisely positioned within a horizontal plane with respect to the tape in order that the sensor face will be parallel to the magnetic plates. As a result, the Savage system is also very speed limited in that wobbling of the tape can result in improper sensing of the magnetic plates or even cause the nonmagnetic ribbon to jump from its guides. Further, the Savage system is limited in the number of control functions available from a single tape.

In U.S. Pat. Nos. 3,674,113 and 3,765,510, the present inventor disclosed elevator control systems in which cams positioned along control wires activate mechanical switches on the elevator. Although those systems avoid the close tolerance requirements of the elevator position, they are speed limited due to the mechanical switching required. Further, although several functions can be controlled from a single wire, two wires are generally required where great flexibility in elevator control is required.

The above elevator control systems are adequate where an elevator does not travel at a speed more than about 200 feet per minute. However, with speeds greater than that, the close tolerance requirements or mechanical switching make those systems less useful. Further, in a building having a large number of floors, the cost and weight of the Savage ribbons and plates and the cost of multiple ribbon or wire systems can be prohibitive.

In light of the above prior art, it is an object of this invention to provide an elevator control system which is not so speed limited as past systems and which will be useful in a range of elevator speeds as high as 1800 feet per minute and more.

It is a further object of this invention to provide an elevator control system which avoids many of the requirements for close mechanical tolerances.

It is a further object of this invention to provide an elevator control system wherein the control elements are less weighty than prior art elements and wherein a single control element can control several elevator functions.

SUMMARY OF THE INVENTION

In accordance with principles of this invention, a control element in the form of a nonmagnetic wire or rod is provided. Coatings of magnetic material are provided along selected segments of the length of wire or rod and those coatings are detected by sensors on the elevator.

In accordance with still further principles of this invention, the response of the elevator control circuit to the sensed magnetic coatings is determined by the length of those coatings.

In accordance with still further principles of the invention, three sensors are arranged to give an upcount when the sensors pass a coating of predetermined length in one direction and a downcount when passing the same coating in another direction.

In accordance with further principles of the invention, additional sensors provide for slowdown and leveling functions.

BRIEF DESCRIPTION OF THE DRAWINGS

The foregoing and other objects, features, and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DESCRIPTION OF THE PREFERRED EMBODIMENTS

Figure 1:
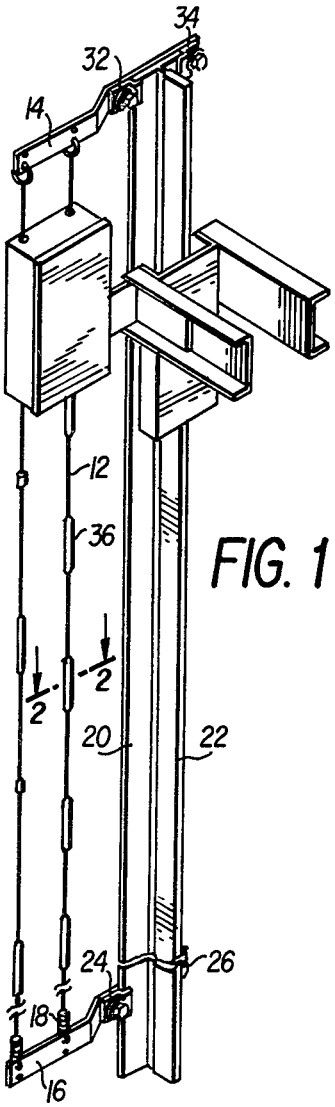
FIG. 1 is an isometric view of a control element in accordance with this invention.

Referring to FIG. 1, a control element 12 in the form of a wire or rod extends from a support 14 at one end of the elevator shaft, not shown, to a support 16 at the lower end of the elevator shaft. Tension in the wire or rod is maintained by a spring 18 between the support 16 and the lower end of the wire or rod 12. The wire or rod 12 will thus extend parallel and close to a wall of the elevator shaft. Lower wire support 16 is mounted for movement along guide rails 20 and 22 by arms 24 and 26 fixed to the wire support. Similarly, the upper wire support 14 is mounted to guide rails 20 and 22 by arms 32 and 34. The wire 12 is made of nonmagnetic material such as bronze. Along selected segments thereof, a magnetic target coating 36 is wrapped around the bronze wire. The target material may be, for example, iron. It will be understood from a further description of the control system that at least one such target will be provided between each two floors or stations in the system. It will also be understood from a further description that the length of each target will determine the elevator function being controlled.

Figure 2:
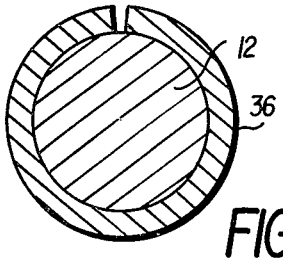
FIG. 2 is a cross-sectional view of the target of FIG. 1 taken along line 2—2 prior to crimping of the target on the wire.

As shown in FIG. 2, the target may be a soft iron sheet which is wrapped around the nonmagnetic wire. In final assembly, the target may be crimped onto the wire at a precise location.

Figure 3:
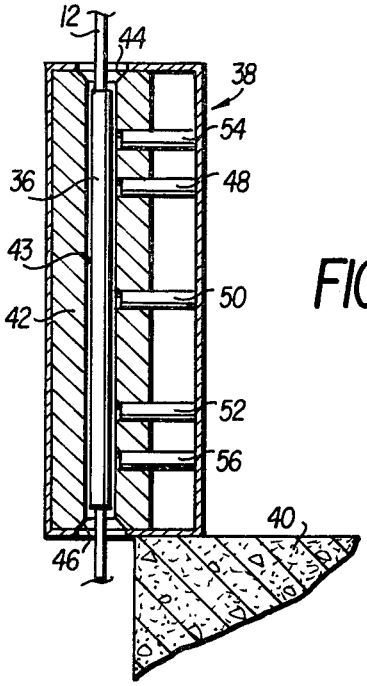
FIG. 3 is a cross-sectional view of a sensor box demonstrating the relationship of the sensors to the control element.

Referring to FIG. 3, a sensor housing 38 is mounted to elevator 40. The housing 38 includes a nonmagnetic sensor support and guide element 42 having a channel 43 therethrough for guiding a control wire 12 and the magnetic targets such as target 36. Mounted within guide element 42 and along channel 43 are five magnetic sensors including a first down-sensor 48, a second center sensor 50, a third upsensor 52, a fourth upper level-sensor 54 and a fifth lower level-sensor 56. The sensors are preferably of the type disclosed in U.S. Pat. No. 3,172,976 to Abel. In each sensor, a pair of electrical contacts close when a magnetic material is positioned within channel 43 on a horizontal plane with the sensor. The sensors are set back a short distance from the channel to prevent direct contact with the targets.

By reference back to FIG. 1, it is apparent that the wire 12 is self-centering with respect to guide channel 43 because the wire supports are free to move along their respective guide rails. Further, a close tolerance in the relative diameters of the targets and guide channel is not required. It is sufficient that the guide channel keep the magnetic targets within the minimum/maximum range of the sensors. It should also be understood that because each target completely surrounds the control wire, there is no requirement that each sensor be precisely oriented around the channel. They need only be located in a predetermined horizontal plane.

Figure 4:
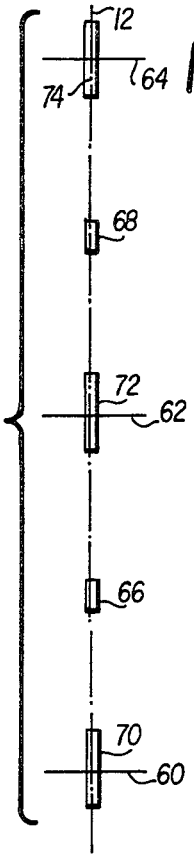
FIGS. 4–6 show the relative size and positions of magnetic targets along a control element in accordance with three separate embodiments of the invention.

Referring now to FIG. 4, a specific embodiment of the control system will be set forth. In this embodiment, the floor levels are equally spaced. Three levels 60, 62 and 64 are shown; however, it should be understood that by merely adding to the length of the control wire and providing additional magnetic targets, any number of floors may be serviced. Step indicator targets 66 and 68 are provided between respective levels. When these targets are detected by the sensor bank mounted to the elevator, a counter will step up or down depending on which direction the elevator is moving. The elevator control circuit thereby has an indication of which floor is being approached. In this embodiment, targets 66 and 68 also indicate the points at which an elevator should begin to slow down in order to stop at a specific level.

Fixed to the same wire 12, level indicator targets 70, 72 and 74 are provided, one for each level. These level indicating targets are longer than the step indicator targets and will not cause the control counter to step up or down. As will be described subsequently, these targets do provide a means for leveling the elevator at each floor. It should be understood that for purposes of clarity, the lengths of the targets shown relative to the spacing between floors are exaggerated.

Figure 7:
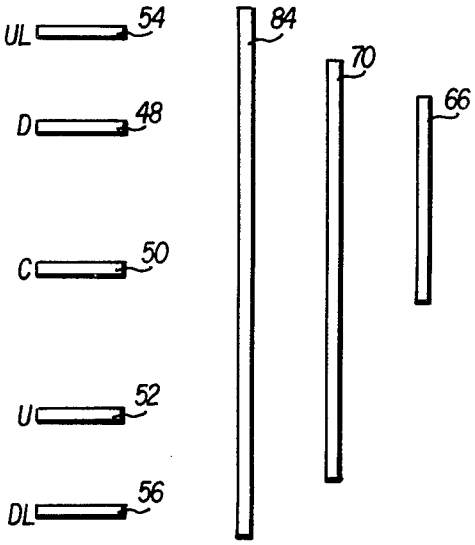
FIG. 7 shows the relative sensor spacing and target lengths in accordance with the several embodiments of this invention.

In order for the control circuitry to distinguish between step indicator targets and level indicator targets, it is necessary that the lengths be determined relative to the spacing between the five sensors. Referring to FIG. 7, it can be seen that the step indicator target 66 is longer than the distance between sensors 48 and 50 as well as the distance between sensors 50 and 52. Target 66 is shorter than the distance between sensors 48 and 52. Level indicator target 70 has a length greater than the distance between sensors 48 and 52 but less than the distance between sensors 54 and 56. The closer the length of target 70 is to the distance between sensors 54 and 56 the more precise the levelling operation will be.

Figure 8:
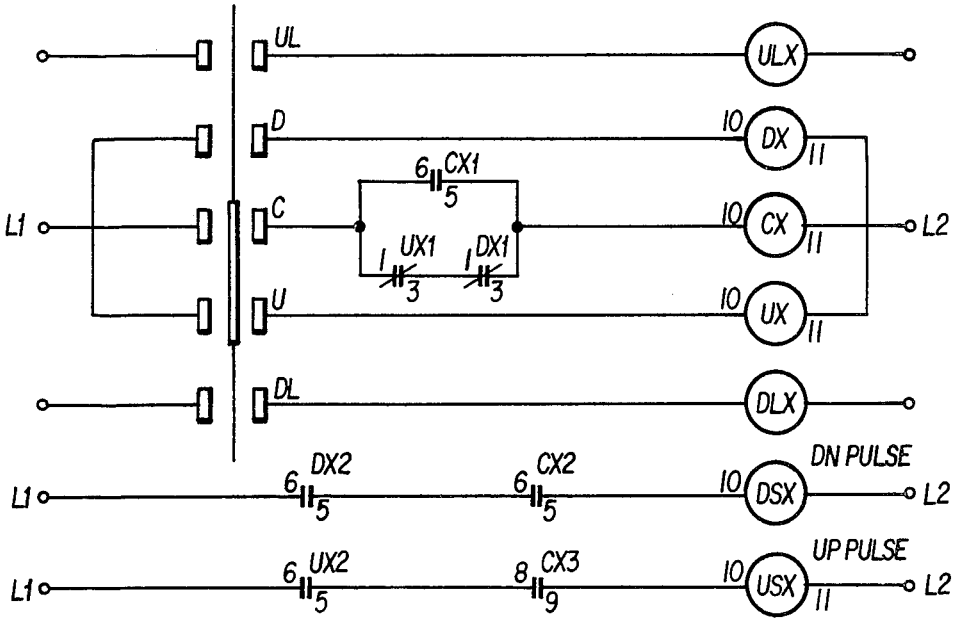
FIG. 8 is a schematic of an electrical circuit which responds to the sensors used in the embodiment of FIG. 4.

Referring now to FIG. 8, the circuitry which responds to the magnetic targets will be described. In the drawings, letter designations have been used to clarify the correspondence between each of the sensors, relay coils, and relay contacts. Hence, the relay coil DX is responsive to down-sensor contacts D and relay coil DX controls relay contacts DX1 and DX2. Relay coil CX is responsive to center sensor contacts C and controls relay contacts CX1, CX2, CX3. Similarly, relay coil UX is responsive to up-sensor U and controls contacts UX1 and UX2. Relays ULX and DLX are responsive to respective level-sensors UL and DL for level control.

As shown, normally open contacts CX1 are in a circuit parallel to normally closed contacts UX1 and DX1, the parallel circuit being in series with center sensor contacts C and center relay CX. Assume now that the sensors are approaching a short target 66 while moving down. As sensor DL reaches the target, those contacts close. This causes current to flow through relay coil DLX which closes contacts not shown in a leveling circuit. However, because the leveling circuit is disengaged prior to slowdown of the elevator, there is no response to the closing of contacts DL at this time.

Sensor U passes down adjacent the target, closing contacts U and thus causing current to flow through relay coil UX. With current flowing through coil UX, normally closed contacts UX1 open. Because the step indicator target is longer than the distance between sensors C and U, contacts UX1 are still open when sensor C reaches the target. At this point, with contacts UX1 open and normally open contacts CX1 still open, current does not flow through relay coil CX. With the sensors continuing to move down, sensor U passes the target, thereby opening contacts U and stopping current flow through relay coil UX. As a result, contacts UX1 return to their normally closed condition. With contacts C still closed and contacts UX1 and DX1 now closed, current flows through relay coil CX thereby closing contacts CX1.

The sensors then continue down until sensor D detects the target, closing contacts D and causing current to flow through relay coil DX. Due to the length of the target, contacts C are still closed. With current flow through relay DX, contacts DX1 open. However, because contacts CX1 are already closed, relay coil CX and contacts CX1 act as a self holding relay with current continuing to flow therethrough. With current flowing simultaneously through relay coils CX and DX, both sets of contacts CX2 and DX2 close, thereby causing current flow through a downstepping coil DSX. With current flow through relay coil DSX a stepping relay, not shown, which acts as a counter will make one step down to indicate that the elevator is approaching the next lower level.

It should be noted that there was no step up when the target bridged sensors C and U because as the target passed sensor U self-holding contacts CX1 were not yet closed. Hence, current did not simultaneously conduct through relay coils CX and UX to close contacts CX3 and UX2 and thus current did not flow through the up-stepping USX coil of the stepper relay.

Of course, if the elevator had been moving upwardly, self-holding contact CX1 would not have closed until after sensor D first passed the target and then, with current flowing simultaneously through coil Cx and UX, contacts CX3 and UX2 would be simultaneously closed giving an upcount.

In the system of FIG. 4 wherein all floor levels are equally spaced, the elevator control circuit further responds to the step signal to provide a slowdown signal when the elevator is to stop at the next floor.

The above-described circuitry responds to give a count only when a step indicator target passes and not when a level indicator target passes. This is because the entire time the contacts C are closed, due to the length of the level indicator target, either contacts UX1 or DX1 are open and thus self-holding contacts CX1 will never have the opportunity to close.

Once the elevator has passed the step indicator target and begins to slow down, the level control circuit is engaged. When the elevator properly stops at a floor, the level indicator target is positioned between sensors UL and DL. Hence, if the elevator should overshoot while moving in a downward direction, the contacts to sensor UL close, causing current to flow through relay ULX which closes a contact in the leveling control circuit not shown. Similarly, if the elevator stops too soon while moving in a downward direction, contacts DL close, thereby causing current flow through relay coil DLX and closing of corresponding contacts in the leveling control circuit.

From the above description, it can be seen that by using a bank of sensors along a single control wire, and by using various length targets, multiple functions can be controlled from a single control wire. One disadvantage of the above arrangement, however, is that where the distance between floors is varied within a single system, the slowdown signals given by the step indicator targets will result in varying slowdown times, the longer times being more than is necessary. To overcome this problem, slowdown targets could be provided on a second wire as in prior art approaches. It is preferred, however, that a single wire provide for the multiple functions even with varied level spacing and this can be accomplished by either of the embodiments shown in FIGS. 5 and 6.

Figure 5:
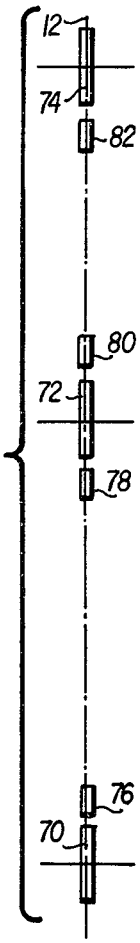

Referring to FIG. 5, step indicator targets 76, 78, 80 and 82 are provided on either side of the each level indicator target at the proper slowdown distance. This system operates in much the same way as did that shown in FIG. 4; however, the elevator control circuit must allow for a double count from the stepping relay for each floor.

Figure 6:
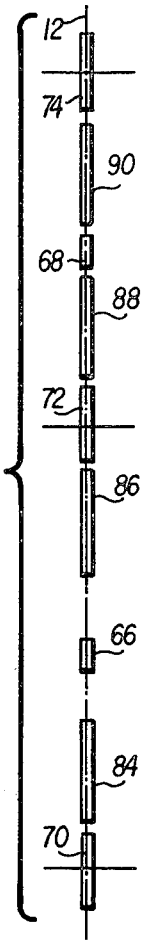

In the system shown in FIG. 6, a single step indicator target is positioned between each floor level and thus only a single count is received at the stepping relay for each floor. To provide for slowdown times independent of the distance between floors, additional slowdown targets 84, 86, 88 and 90 are provided. As shown in FIG. 7, the slowdown targets are longer than the distance between sensors UL and DL.

Figure 9:
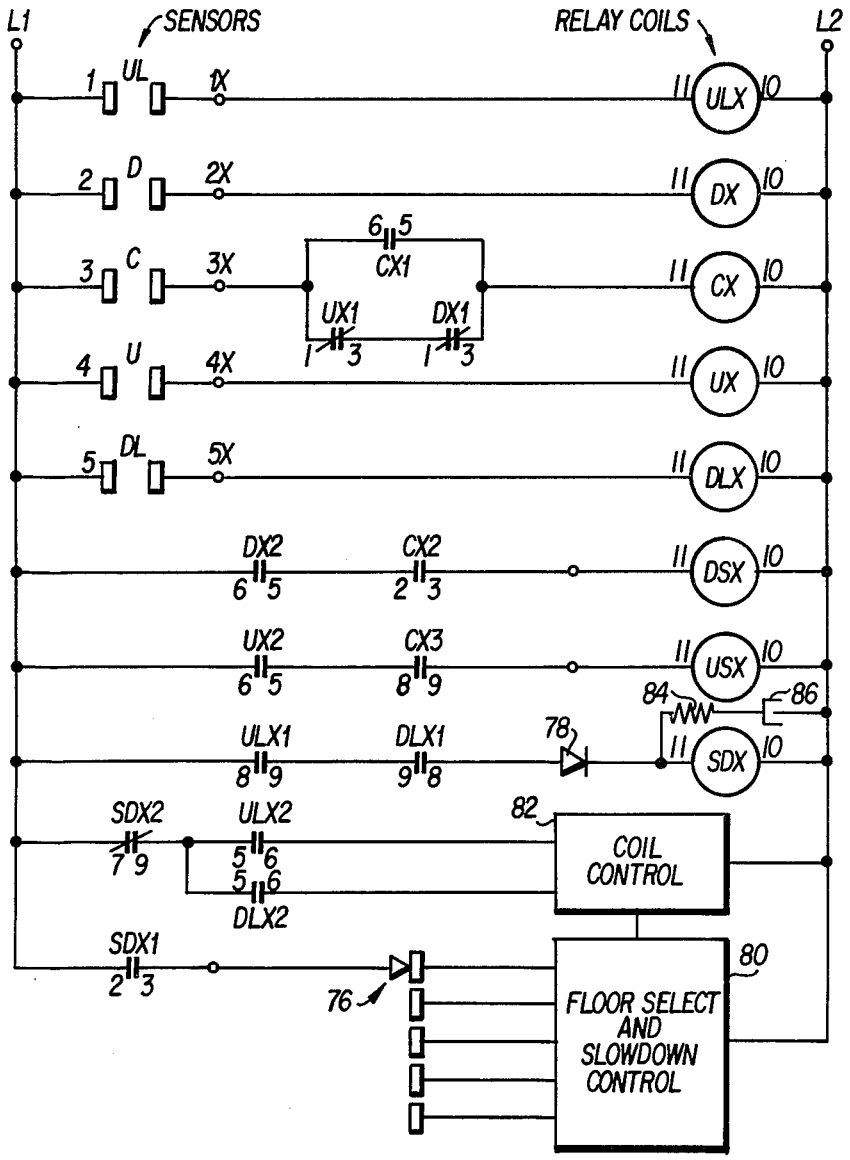
FIG. 9 is a schematic of the electrical circuit responsive to the sensors in the embodiment of FIG. 6.

The circuitry responsive to the sensors in the embodiment of FIG. 6 is shown in FIG. 9. The circuitry for detecing step indicator targets is the same as that in FIG. 8 and like reference letters are used to designate corresponding circuit elements. In addition, the circuit of FIG. 9 shows stepper contact 76 which is moved up or down depending on whether current flows through stepper relay coils DSX or USX. Also, FIG. 9 includes circuitry for detecting the long slowdown target. That circuit includes contacts ULX1, DLX1, and relay SDX.

In operation, when the long target bridges sensors UL and DL, current conducts through relays ULX and DLX, thereby closing contact ULX1 and DLX1. With both contacts ULX1 and DLX1 closed, current conducts from line L1 through diode 78 and slowdown relay coil SDX. With current flow through coil SDX, contacts SDX1 close. Current then flows through the stepper contacts if the floor indicated by the stepper contacts has been selected. With this current flow, the floor select and slowdown control circuit 80 begins to slow the elevator down.

In very high speed systems it may be necessary for the elevator to begin slowing down more than a floor away from the selected floor. In that case, the slowdown control may be designed to respond to an earlier slowdown target.

With the elevator slowing down, the level control circuit 82 is engaged. Even after one of the contacts ULX1 or DLX1 opens, current continues to flow through coil SDX for an additional short time period due to the RC circuit comprising resistor 84 and capacitor 86. With current still flowing through coil SDX, normally closed contact SDX2 is held open and thus prevents triggering of the level control circuit before all five sensors have passed the slowdown target. After that time delay, contacts SDX2 again close. The next target passed by the sensors is the level indicator target. If the elevator is moving down, contact DL is first to close, causing current flow through relay DLX and closing of contacts DLX2. With contacts DLX2 closed, the level control circuit causes the elevator to continue moving downwardly. When sensor DL passes the leveling target, contacts DLX2 open and the elevator comes to a stop. However, if the elevator should overshoot, the leveling target is sensed by sensor UL closing contact UL and causing current to flow through relay coil ULX. This closes contact ULX2 and the level control circuit causes the elevator to move back up until contacts ULX2 open.

With this final embodiment, a single wire control element is used to control counter stepping, slowdown, and leveling functions in a high speed elevator system having variable distances between floor levels. This result is made possible by the use of magnetic targets of various predetermined lengths spaced along a control wire or rod and by the use of discriminating circuitry.

While the invention has been particularly shown and described with reference to preferred embodiments thereof, it will be understood by those skilled in the art that various changes in form and details may be made therein without departing from the spirit and scope of the invention as defined by the appended claims. For example, semiconductor devices may replace certain of the switching circuits.

I claim:

1. A control system for automatically controlling the motion of a body in either of two opposite directions along a track past a plurality of stations including end stations and at least one intermediate station so as to position said body at selected stations comprising:

step indicator means extending along selected first segments of said track, each of said first segments being of a predetermined length;

sensor means on said body comprising at least first, second, and third sensor elements positioned along a line parallel to said track such that each sensor will sense said step indicator means when that sensor is positioned adjacent the step indicator means along a line transverse to said track, the distance between said first and second sensor elements and the distance between said second and third sensor elements each being less than the predetermined length of said first segments and the distance between said first and third sensor elements being greater than the predetermined length of said first segments, means for disabling said second sensor for as long as either of the first or third sensors senses the step indicator means, but only when that first or third sensor senses the step indicator means before the second sensor senses the step indicator means, and counter means for indicating the station being approached by said body, said counter means counting up when said first and second sensors simultaneously sense said step indicator means and for counting down when said second and third sensors simultaneously sense said step indicator means.

2. The control system of claim 1 wherein said means for disabling said second sensor comprises a self-holding relay in electrical series with said second sensor and first and second sets relay contacts in series with the coil of said self-holding relay, said first set of relay contacts being controlled by a relay coil in the first sensor circuit and said second set of relay contacts being controlled by a relay coil in the third sensor circuit.

3. The control system of claim 1 further comprising: slowdown indicator means extending along selected second segments of said track, each of said second segments being of a predetermined length greater than the distance between said first and third sensor elements, fourth and fifth sensor elements on said body in line with said first, second, and third sensor elements, the distance between said fourth and fifth sensor elements being greater than the length of said first segments but less than the length of said second segments, and speed control means responsive to said fourth and fifth sensor elements simultaneously sensing said slowdown indicator means to slow down said body as the body approaches a selected station.

4. The control system of claim 3 further comprising:

level indicator means extending along selected third segments of said track, each of said third segments being of a predetermined length greater than the distance between said first and third sensor elements but less than the distance between said fourth and fifth sensor elements, level control means responsive to the sensing of said level indicator means by said fourth and fifth sensors elements for locating said body such that said level indicator means is positioned between the fourth and fifth sensor elements, and means for disabling said level control means prior to slowdown of said body.

5. The control system of claim 1 further comprising:

level indicator means extending along selected third segments of said track, each of said third segments being of a length greater than the distance between said first and third sensor elements, fourth and fifth sensor elements on said body in line with said first, second and third sensor elements, the distance between said fourth and fifth sensor elements being close to the length of said third segments, and level control means responsive to the sensing of said level indicator means by said forth and fifth sensors for locating said bodies such that said level indicator means is positioned between the fourth and fifth sensor elements, and means for disabling said level control means until a selected station is approached.

* * * * *